United States Patent [19]

Havel

[11] Patent Number: 4,785,432

[45] **Date of Patent: * Nov. 15, 1988**

[54] DIGITAL DISPLAY TIMEPIECE

[76] Inventor: Karel Havel, P.O. Box 66, Station M, Toronto, Ontario, Canada, M6S 4T2

[ * ] Notice: The portion of the term of this patent subsequent to Nov. 10, 2004 has been disclaimed.

[21] Appl. No.: 113,255

[22] Filed: Oct. 27, 1987

Related U.S. Application Data

[63] Continuation-in-part of Ser. No. 30,470, Mar. 26, 1987, Pat. No. 4,702,615, which is a continuation-in-part of Ser. No. 946,036, Dec. 24, 1986.

[51] Int. Cl.[4] ..... G04C 19/00; G09G 1/28

[52] U.S. Cl. ..... 368/82; 368/107; 340/701

[58] Field of Search ..... 368/10, 11, 82–84, 368/239–242; 340/701

[56] References Cited

U.S. PATENT DOCUMENTS

| | | | |
|---|---|---|---|
| 4,044,546 | 8/1977 | Kolke | 368/71 |
| 4,702,615 | 10/1987 | Havel | 368/82 |
| 4,705,406 | 11/1987 | Havel | 368/10 |

FOREIGN PATENT DOCUMENTS 55-107984 8/1980 Japan .

*Primary Examiner*—Vit W. Miska

[57] ABSTRACT

A timepiece includes a variable color digital display for exhibiting a digital indication of time. A comparator and color control are provided for controlling the color of the digital indication in accordance with its relation to predetermined low and high time limits such that time before the low time limit is indicated in a first color, time after the high time limit is indicated in a second color, and time between the low and high time limits is indicated in a third color.

3 Claims, 3 Drawing Sheets

RED BUS
GREEN BUS
5
6
63a
63b
60a
60b
R
Y
G
16
15
2e
3e

RED
GREEN
2a
3a
2b
3b
2c
3c
2d
3d
2e
3e
2f
3f
2g
3g
a
b
c
d
e
f
g
3
42
23
A0
A1
A2
A3
7 SEGMENT
DECODER

DIGITAL DISPLAY TIMEPIECE

CROSS-REFERENCE TO RELATED APPLICATIONS

This is a continuation-in-part of my copending application Ser. No. 07/030,470, filed Mar. 26, 1987 and entitled Analog Display Timepiece, now U.S. Pat. No. 4,702,615 issued October 27, 1987, which is a continuation-in-part of my copending application Ser. No. 06/946,036, filed Dec. 24, 1986 and entitled Variable Color Analog Voltmeter.

Reference is also made to my copending applications Ser. No. 06/819,111, filed on Jan. 15, 1986, entitled Variable Color Digital Multimeter, Ser. No. 06/940,100, filed on Dec. 10, 1986, entitled Digital Voltmeter with Variable Color Background, and Ser. No. 07/000,478, filed on Jan. 5, 1987, entitled Variable Color Digital Tachometer, in which is disclosed the subject matter of digital comparators for developing color control signals.

BACKGROUND OF THE INVENTION

1. Field of the Invention

This invention relates to timepieces utilizing variable color digital display.

2. Description of the Prior Art

A digital electronic timepiece disclosed in U.S. Pat. No. 4,044,546, issued Aug. 30, 1977 to Mitsuo Koike, utilizes a variable color liquid crystal 2-digit display on which seconds, minutes, hours, days, and dates may be sequentially displayed in respectively different colors.

A digital electronic watch for discriminating a.m. and p.m. times by altering the color of a digital indicator for indicating time is disclosed in Japanese Pat. No. 55-107984 issued Aug. 19, 1980 to Toshiyuki Itou.

SUMMARY OF THE INVENTION

It is the principal object of this invention to provide an improved variable color digital timepiece capable of simultaneously indicating values of time and their relation to predetermined low and high time limits.

In summary, a timepiece of the present invention includes a timekeeping device for measuring time and a variable color digital display for exhibiting a digital indication of time. A comparator is provided for comparing the instant measured value of time with a low time limit and a high time limit, respectively stored in limit memories, and for developing comparison signals accordingly. Color control responsive to the comparison signals causes the digital indication to illuminate in a color in accordance with the relation of the instant value of time to the low and high time limits.

BRIEF DESCRIPTION OF THE DRAWINGS

In the drawings in which is shown the preferred embodiment of the invention.

Throughout the drawings, like characters indicate like parts.

DESCRIPTION OF THE PREFERRED EMBODIMENT

Figure 1:
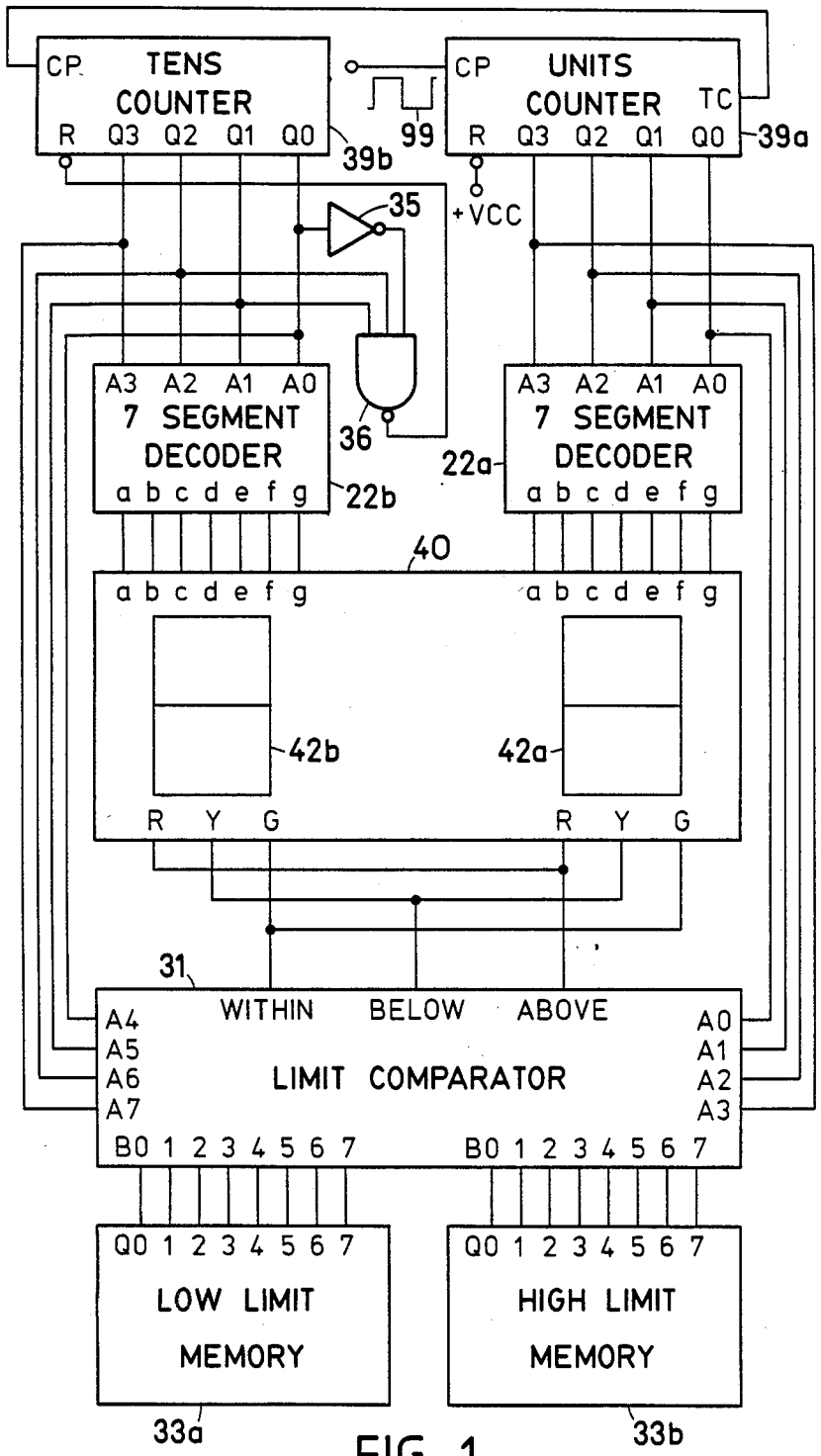
FIG. 1 is a simplified schematic diagram of a digital timepiece with variable color display.

Referring now, more particularly, to the drawings, in FIG. 1 is shown a simplified schematic diagram of a variable color digital timepiece of the invention. The clock pulses 99 of a stable frequency are applied to clock pulse input CP of decade counter 39*a*, referred to as Units Counter, for incrementing its contents at regular time intervals, e.g., once a minute. The terminal count output TC of counter 39*a* is coupled to CP input of counter 39*b*, referred to as Tens Counter, for incrementing its contents ten times slower. The circuit including 3-input NAND gate 36 and inverter 35 serves to reset counter 39*b* when it attempts to reach the count of 6, thereby allowing it to count only from 0 to 5. The accumulated counts in counters 39*a*, and 39*b*, representing the time code, are available at the outputs Q0, Q1, Q2, and Q3 of counters 39*a* and 39*b*, which are respectively coupled to inputs A0 to A3 of 7-segment decoders 22*a* and 22*b*. The outputs a, b, c, d, e, f, and g of decoders 22*a* and 22*b* are directly coupled to like inputs a, b, c, d, e, f, and g of display element 42*a*, for indicating minutes, and of display element 42*b*, for indicating tens of minutes, to exhibit the value of time in digital format on display 40 in a manner well understood by those skilled in the art. It would be obvious to add additional counters and display elements to provide indication of hours and seconds.

The invention resides in the addition of a limit comparator 31, having its inputs A0 to A7 respectively coupled to outputs Q0 to Q3 to counters 39*a* and 39*b*, for comparing the instant value of the time code, representing the displayed value of time, with a low time limit, stored in a low limit memory 33*a*, and a high time limit, stored in a high limit memory 33*b*. Limit comparator 31 develops active comparison signal WITHIN for the value of the time code being within the bounds of the low time limit and the high time limit, active comparison signal BELOW for the value of the time code being less than the low time limit, and active comparison signal ABOVE for the value of the time code being larger than the high time limit. The color control inputs R (red), Y (yellow), and G (green) of display elements 42*a* and 42*b* are respectively interconnected, for causing them to illuminate in uniform colors, and coupled to comparator outputs WITHIN, BELOW, and ABOVE. The display elements 42*a* and 42*b* illuminate in green color in response to active comparison signal WITHIN, in yellow color in response to active comparison signal BELOW, and in red color in response to active comparison signal ABOVE. It would be obvious that the color sequences could be readily changed by differently interconnecting the outputs of limit comparator 31 with the color control inputs of display 40.

Figures 2, 3:
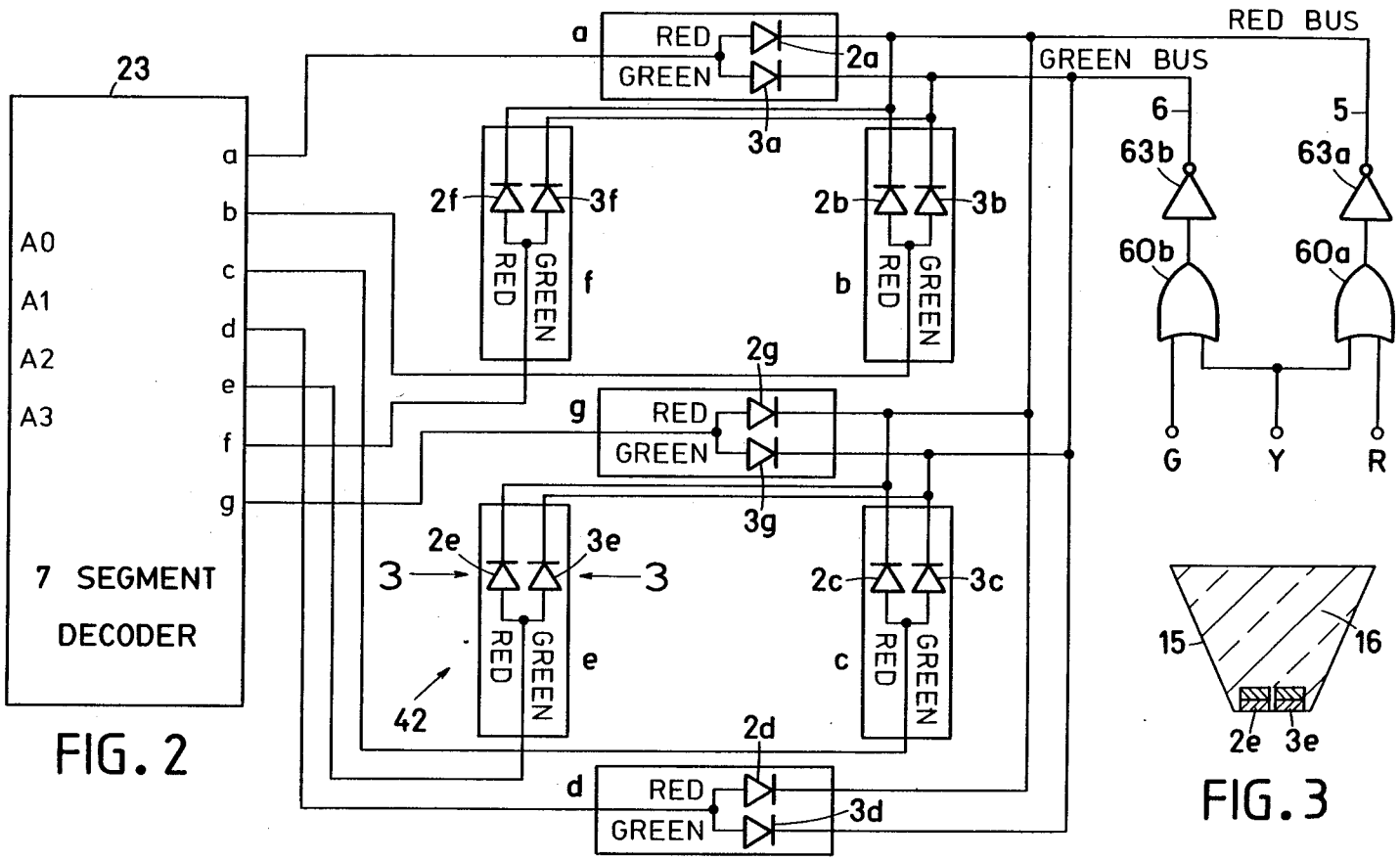
FIG. 2 is a schematic diagram of one variable color display element.
FIG. 3 is an enlarged cross-sectional view of one display segment in FIG. 2, taken along the line 3—3.

In FIG. 2 is shown a schematic diagram of 2-primary color common cathodes 7-segment display element 42 which can selectively display various digital fonts in different colors. The display element 42 includes seven elongated display segments a, b, c, d, e, f, and g, arranged in a conventional pattern, which may be selectively energized in different combinations to display desired digits. Each display segment includes a pair of LEDs (light emitting diodes): a red LED 2 and green LED 3, which are closely adjacent such that the light signals emitted therefrom are substantially superimposed upon each other to mix the colors. To facilitate the illustration, the LEDs are designated by segment symbols, e.g., the red LED in the segment a is designated as 2a, etc. The anodes of all red and green LED pairs are interconnected in each display segment and are electrically connected to respective outputs of a commercially well known common-cathode 7-segment decoder 23. The cathodes of all red LEDs 2a, 2b, 2c, 2d, 2e, 2f, and 2g are interconnected to a common electric path referred to as a red bus 5. The cathodes of all green LEDs 3a, 3b, 3c, 3d, 3e, 3f, and 3g are interconnected to a like common electric path referred to as a green bus 6. The color of the display element may be controlled by applying proper combinations of logic level signals to color control inputs R (red), Y (yellow), and G (green).

The operation of display 42 will be explained on example of illuminating digit '7' in three different colors. Any digit between 0 and 9 can be selectively displayed by applying the appropriate BCD code to the inputs A0, A1, A2, and A3 of decoder 23. The decoder 23 develops drive signals at its outputs a, b, c, d, e, f, and g for energizing selected groups of the segments to visually display the selected number, in a manner well known to those having ordinary skill in the art. To display decimal number '7', a BCD code 0111 is applied to the inputs A0, A1, A2, and A3. The decoder 23 develops high voltage levels at its outputs a, b, and c, to illuminate equally designated segments, and low voltage levels at all remaining outputs, to extinguish all remaining segments d, e, f, and g.

To illuminate display 42 in red color, the color control input R is raised to a high logic level, and color control inputs Y and G are maintained at a low logic level. As a result, the output of OR gate 60a rises to a high logic level, thereby forcing the output of inverting buffer 63a to drop to a low logic level. The current flows from the output a of decoder 23, via red LED 2a and red bus 5, to current sinking output of buffer 63a. Similarly, the current flows from the output b of decoder 23, via red LED 2b and red bus 5, to the output of buffer 63a. The current flows from the output c of decoder 23, via red LED 2c and red bus 5, to the output of buffer 63a. As a result, the segments a, b, and c illuminate in red color, thereby causing a visual impression of a character '7'. The green LEDs 3a, 3b, 3c remain extinguished, because the output of buffer 63b is at a high logic level, thereby disabling green bus 6.

To illuminate display 42 in green color, the color control input G is raised to a high logic level, while the color control inputs R and Y are maintained at a low logic level. As a result, the output of OR gate 60b rises to a high logic level, thereby forcing the output of inverting buffer 63b to drop to a low logic level. The current flows from the output a of decoder 23, via green LED 3a and green bus 6, to current sinking output of buffer 63b. Similarly, the current flows from the output b of decoder 23, via green LED 3b and green bus 6, to the output of buffer 63b. The current flows from the output c of decoder 23, via green LED 3c and green bus 6, to the output of buffer 63b. As a result, the segments a, b, and c illuminate in green color. The red LEDs 2a, 2b, and 2c remain extinguished because the output of buffer 63a is at a high logic level, thereby disabling red bus 5.

To illuminate display 42 in yellow color, the color control input Y is raised to a high logic level, while the color control inputs R and G are maintained at a low logic level. As a result, the outputs of both OR gates 60a, 60b rise to a high logic level, thereby forcing the outputs of both buffers 63a, 63b to drop to a low logic level. The current flows from the output a of decoder 23, via red LED 2a and red bus 5, to current sinking output of buffer 63a, and, via green LED 3a and green bus 6, to current sinking output of buffer 63b. Similarly, the current flows from the output b of decoder 23, via red LED 2b and red bus 5, to the output of buffer 63a, and, via green LED 3b and green bus 6, to the output of buffer 63b. The current flows from the output c of decoder 23, via red LED 2c and red bus 5, to the output of buffer 63a, and, via green LED 3c and green bus 6, to the output of buffer 63b. As a result of blending light of red and green colors in each segment, the segments a, b, and c illuminate in substantially yellow color.

In FIG. 3, red LED 2e and green LED 3e are placed on the base of a segment body 15, which is filled with a transparent light scattering material 16. When forwardly biased, LEDs 2e and 3e emit light signals of red and green colors, respectively, which are scattered within the transparent material 16, thereby blending the red and green light signals into a composite light signal that emerges at the upper surface of the segment body 15. The color of the composite light signal may be controlled by varying the portions of the red and green light signals.

Figure 4:
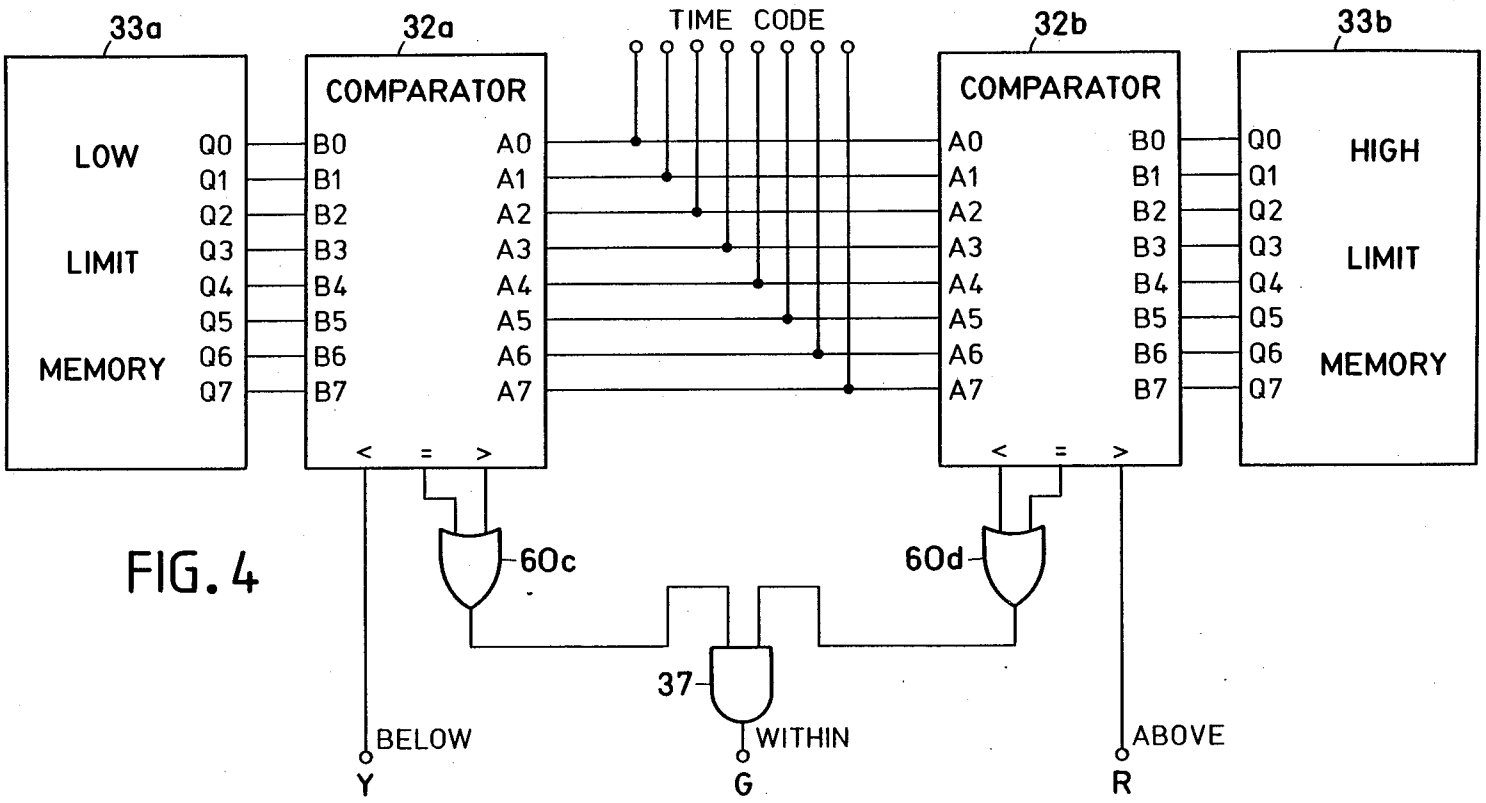
FIG. 4 is a schematic diagram showing the detail of the limit comparator in FIG. 1.

In the detail of the limit comparator shown in FIG. 4, 8-bit time code from the outputs Q0 to Q3 of counters 39a and 39b, shown in FIG. 1, is respectively applied to interconnected inputs A0 to A7 of digital comparators 32a and 32b. The 8-bit data stored in low limit memory 33a, representing the low time limit, are respectively applied from outputs Q0 to Q7 to inputs B0 to B7 of digital comparator 32a; the 8-bit data stored in high limit memory 132b, representing the high time limit, are respectively applied from outputs Q0 to Q7 to inputs B0 to B7 of digital comparator 32b. The digital comparators 32a and 32b effect a comparison between the value of the instant time code and low and high time limits and accordingly develop the output signals '<', '=', and '>'. When the time code is less than the low time limit, the output '<' rises to a high logic level to develop active comparison signal BELOW for illuminating display 40 in yellow color. When the time code is greater than the high time limit, the output '>' rises to a high logic level to develop active comparison signal ABOVE for illuminating display 40 in red color. When the time code is between the low and high time limits, one of inputs of each OR gates 60c, 60d rises to a high logic level, thereby forcing both inputs of AND gate 37 to rise to a high logic level, which in turn causes its output to rise to a high logic level to develop active comparison signal WITHIN for illuminating display 40 in green color.

Although not shown in the drawings, it will be appreciated that the timepiece of the invention may have any conceivable form or shape, such as a wrist watch, pocket watch, clock, alarm clock, and the like. Alternatively, the timepiece may have characteristics of an article for wearing on a body of wearer or for securing to wearer's clothing, such as a bracelet, ring, ear-ring, necklace, tie tack, button, cuff link brooch, hair ornament, and the like, or it may be built into, or associated with, an object such as a pen, pencil, ruler, lighter, briefcase, purse, and the like.

In brief summary, the invention describes a method of simultaneously indicating values of time and their relation to predetermined low and high time limits, on a single variable color digital display, by causing a digital indication of time to be exhibited on the display, and by illuminating the digital indication in one of three respectively different colors in accordance with its relation to the time limits.

A variable color digital timepiece was disclosed which includes a timekeeping device, variable color digital display for providing a digital indication of a value of time, and a comparator for comparing the instant value of time with predetermined low and high time limits, defining three time ranges, to determine in which time the value of time lies, and for developing comparison signals accordingly. Color control responsive to the comparison signals is provided for illuminating the digital indication in respectively different colors in accordance with the time range in which the value of time lies.

It would be obvious that persons skilled in the art may resort to numerous modifications in the construction of the preferred embodiment shown herein, without departing from the spirit of the invention as defined in the appended claims. It is contemplated that the principles of the invention may be also applied to numerous diverse types of display devices, such are liquid crystal, plasma devices, and the like.

CORRELATION TABLE

This is a correlation table of reference characters, their descriptions, and examples of commercially available parts.

| # | DESCRIPTION | EXAMPLE |
|---|---|---|
| 2 | red LED | |
| 3 | green LED | |
| 5 | red bus | |
| 6 | green bus | |
| 15 | segment body | |
| 16 | light scattering material | |
| 22 | 7-segment decoder | |
| 23 | common cathode 7-segment decoder | 74LS49 |
| 31 | limit comparator | |
| 32 | digital comparator | |
| 33 | limit memory | 74HC373 |
| 35 | inverter | 74HC04 |
| 36 | 3-input NAND gate | 74HC10 |
| 37 | 2-input AND gate | 74HC08 |
| 39 | 4-bit decade counter | 74HC160 |
| 40 | variable color display | |
| 42 | 2-LED variable color display element | |
| 60 | 2-input OR gate | 74HC32 |
| 63 | inverting buffer | 74LS240 |
| 99 | clock pulse | |

What I claim is:

1. A method of simultaneously indicating a value of time and its relation to a predetermined low time limit and a predetermined high time limit, on a single variable color digital display means, by causing a digital indication of time to be exhibited on said display means, by, comparing said value of time with said low time limit and said high time limit to determine their relation, and by controlling the color of said digital indication in accordance with the relation of said value of time to said low time limit and said high time limit such that said digital indication is illuminated in a first color when said value of time is lower than said low time limit, in a second color when said value of time is higher than said high time limit, and a third color when said value of time is within the bounds of said low time limit and said high time limit, said first, second, and third colors being respectively different.

2. A timepiece comprising:

timekeeping means;

variable color digital display means for providing a digital indication of a value of time;

comparator means for effecting a comparison of said value of time with a predetermined low time limit and a predetermined high time limit, defining three time ranges, to determine in which time range said value of time lies, and for developing comparison signals accordingly; and color control means responsive to said comparison signals for causing said digital indication to illuminate in one of three respectively different colors in accordance with the time range in which said value of time lies.

3. A timepiece comprising:

timekeeping means;

variable color digital display means for providing a digital indication of a value of time;

comparator means for effecting a comparison of said value of time with a predetermined low time limit and a predetermined high time limit, defining three time ranges, to determine in which time range said value of time lies, and for developing a first comparison signal for said value of time being lower than said low time limit, a second comparison signal for said value of time being higher than said high time limit, and a third comparison signal for said value of time being within the bounds of said low time limit and said high time limit; and color control means responsive to said comparison signals for causing said digital indication to illuminate in a first color in response to said first comparison signal, in a second color in response to said second comparison signal, and in a third color in response to said third comparison signals, said first, second, and third colors being respectively different.

* * * * *